United States Patent [19]

Rakocy

[11] 4,271,338

[45] Jun. 2, 1981

[54] SECURITY APPARATUS

[75] Inventor: William J. Rakocy, Nutley, N.J.

[73] Assignee: North American Philips Corporation, New York, N.Y.

[21] Appl. No.: 56,168

[22] Filed: Jul. 10, 1979

[51] Int. Cl.[3] ..... H01H 3/16

[52] U.S. Cl. ..... 200/61.71; 200/61.93; 335/205; 340/547

[58] Field of Search ..... 200/61.71, 61.93, 61.72, 200/61.73, 61.62, 61.81; 340/547, 541, 545; 335/205, 206, 207

[56] References Cited

U.S. PATENT DOCUMENTS

| | | | |
|---|---|---|---|
| 3,636,484 | 1/1972 | Lea | 335/205 |
| 4,151,382 | 4/1979 | Kaufman et al. | 200/61.71 |

*Primary Examiner*—B. Dobeck
*Assistant Examiner*—Morris Ginsburg
*Attorney, Agent, or Firm*—Thomas A. Briody; William J. Streeter; Rolf E. Schneider

[57] ABSTRACT

A security device adapted for use with a slidable-type window or the like basically comprises a two-part electrical contact switch, one switch part being mounted on the molding surrounding the window frame and being electrically connectible to an alarm system, and the other switch part being slidably associated with a longitudinal bracket mounted on the window frame adjacent the first switch part. The window frame can be slid open or closed, without activation of the alarm system, by holding the two switch parts in electrical contact with each other.

9 Claims, 5 Drawing Figures

FIG. 1.
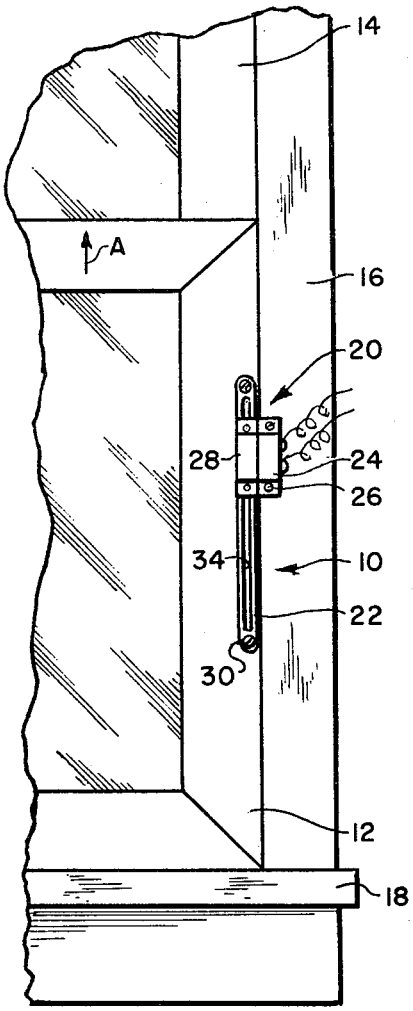
FIG. 2.
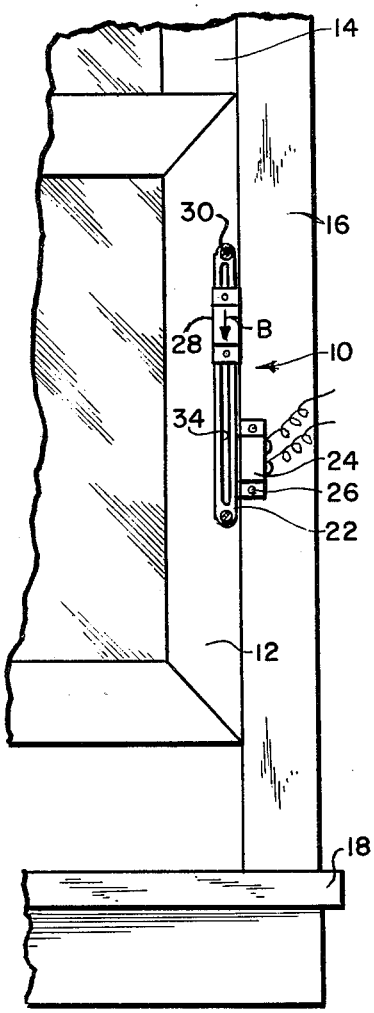
FIG. 3.
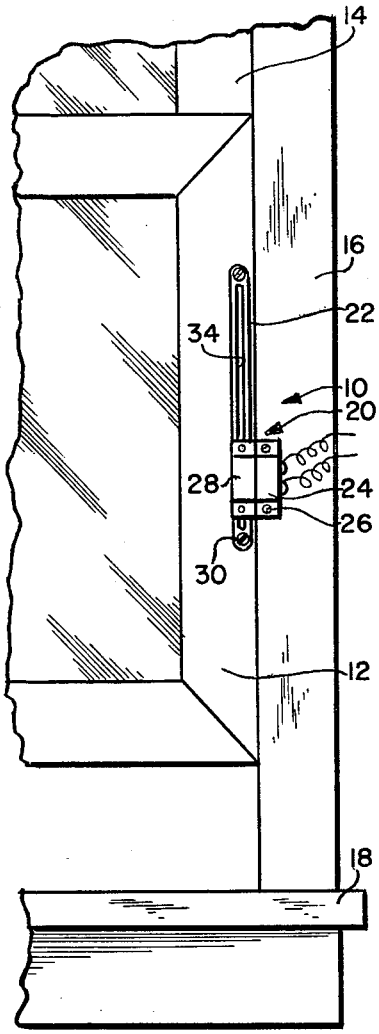
FIG. 4.
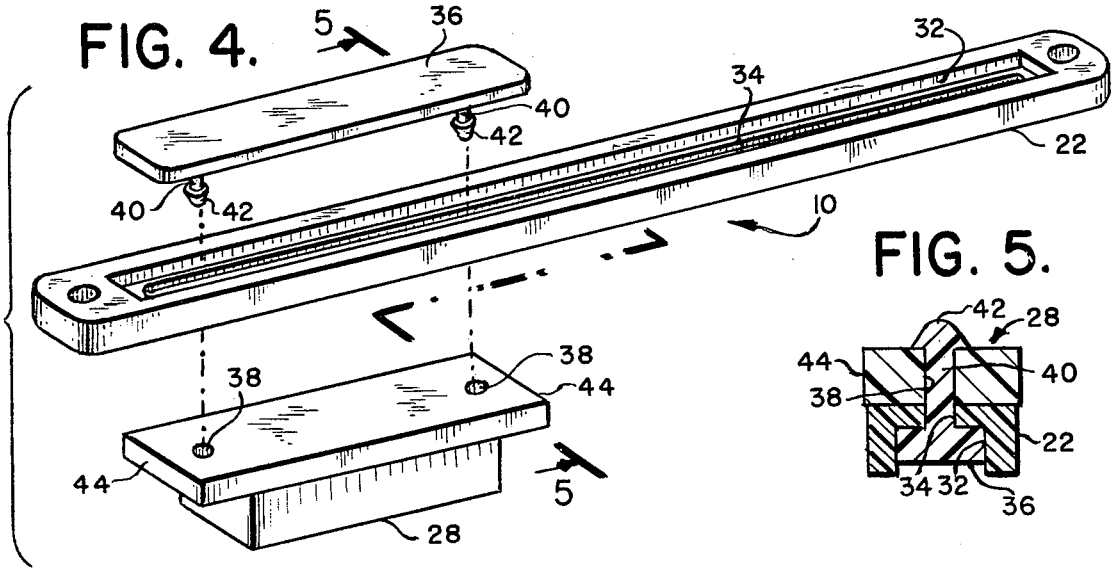
FIG. 5.

SECURITY APPARATUS

This invention relates to security apparatus particularly adapted for use with a slidable-type window or the like.

In order to provide the occupants of premises with an adequate degree of protection against and/or warning of intrusion by an unwanted individual or individuals and/or also to deter any such intruders insofar as possible, various proposals have been made to equip such premises, especially those of a residental nature, with one or another arrangement to accomplish this purpose. Many such suggestions have been quite elaborate and costly and thus beyond the means of the average homeowner. Other suggested arrangements, on the other hand, have not been entirely desirable or satisfactory for one reason or another.

It has now been found that these disadvantages can be substantially nutigated by means of the present invention, which provides an apparatus or device easily installable on a slidable-type window or the like and forming a part of an overall protection or alarm system. Basically, such apparatus comprises a two-part electrical contact switch, one switch part being mounted on the molding surrounding the window frame and being electrically connectible to the alarm system, and the other switch part being slidably associated with a longitudinal bracket mounted on the window frame adjacent the first switch part. The window frame can be slid open or closed, without activation of the alarm system, by holding the two switch parts in electrical contact with each other.

The invention will now be described in greater detail in connection with the accompanying drawings, in which:

FIG. 1 is a partial elevational view of a double-hung window having installed thereon a preferred embodiment of the security device in accordance with the present invention;

FIGS. 2 and 3 are partial elevational views of the double-hung window shown in FIG. 1, with the lower window frame in an open position and with the security device shown in the successive locations assumed by the second switch part;

FIG. 4 is a perspective view on an enlarged scale of the bracket and the second switch part shown in FIGS. 1 to 3; and FIG. 5 is a cross-sectional view, taken along the line 5—5 of FIG. 4, of the assembled bracket and second switch part.

The present security apparatus or device 10 is shown in FIGS. 1 to 3 in place on a double-hung window, the lower window frame 12 of which is slidable with respect to the upper window frame 14. The two window frames are also slidable with respect to the surrounding window molding 16, which is provided with the conventional sill 18.

Device 10 comprises two basic elements, namely, the two-part electrical contact switch 20 and the linearly or longitudinally extending bracket 22. Switch 20 is advantageously a two-part magnetic contact switch as shown. One part 24 of such contact switch is suitably mounted by means of rivets or screws 26 on the window molding 16 and is electrically connected to an alarm-activating system (not shown) of any appropriate type.

The other part 28 of the contact switch is mounted on bracket 22 in a manner so as to be slidable with respect thereto. Bracket 22 is itself attached to the lower window frame 12 as by means of screws 30, such attachment being so arranged that the bracket is adjacent the first switch part 24. Preferably bracket 22 is so attached to the lower window frame that, when such window frame is closed, one end of the bracket is opposite the first switch part, as shown in FIG. 1. The two switch parts are then in electrical contact in this position.

As indicated, when the lower window frame 12 is raised or opened in the direction of the arrow A (see FIG. 1), electrical contact between the two switch parts is broken. Such electrical contact can be immediately re-established, however, once the lower window frame has been raised the desired amount, by slidably lowering switch part 28 along bracket 22 in the direction of the arrow B (see FIG. 2) until such switch part is again opposite and in electrical contact with switch part 24 (see FIG. 3). The opposite procedure is followed when window frame 12 is closed.

To avoid the breaking of the electrical contact between the two switch parts with the consequent temporary activation of the alarm system, the two switch parts 24 and 28 are desirably held in electrical contact with each other during any opening or closing of the lower window frame. It will be appreciated that the window frame 12 may be raised any amount limited only by the length of the bracket 22, which in turn may have any desired length. This security device 10 may alternatively, if desired, be arranged with the bracket appropriately attached to the upper window frame 14. In addition, rather than being arranged vertically as shown, the security device may be arranged horizontally with the first switch part attached, for example, to the sill 18.

As illustrated in FIGS. 4 and 5, bracket 22 is advantageously formed with a U-shaped linear channel 32 suitably designed for slidable contact by the second switch part 28. The bracket may be attached to the window frame 12 in a manner such that channel 32 faces or opens outwardly. In such case the channel is so formed that its outer width is less than its inner or base width and the second switch part 28 is formed with a corresponding cross-section, such switch part 28 thereby being slidably retained within the channel 32.

Preferably, however, bracket 22 is attached to window frame 12 with channel 32 facing inwardly toward such frame. In such case a linearly extending slot 34 is formed in the base of the channel. A member or element 36 is then provided within the channel for association through such slot with the second switch part 28 for slidable retention of such switch part on the bracket.

As indicated, the magnetic switch parts 24 and 28 are each longitudinally shaped, with the second switch part 28 designed to be slidable on the outer surface of the inwardly facing channel 32. In that event element 36 is also longitudinally shaped and slidable within the channel, suitable means being provided for slidably retaining the second switch part 28 and the element 36 together.

For this purpose switch part 28 may be provided with a pair of apertures 38 for engagement by a corresponding pair of projections 40 formed on element 36, such projections protruding through slot 34. Each projection 40 may be provided with a rivet-like end 42 to ensure adequate retention of switch part 28 and element 36 together. Advantageously, apertures 38 may be formed in respective wing-like extensions 44 on switch part 28.

The present security apparatus may be utilized with other slidable-type windows such as, for example, sliding windows per se. This device may further be used in conjunction with any other type of closure comprising a panel-like element slidable with respect to a surrounding molding. Indicative of such an arrangement is a pair of sliding doors.

Except for the electrical and/or magnetic components, which are necessarily metallic, any appropriate material can be employed to form the remaining parts of the security device. A suitable plastic is most generally utilized for this latter purpose.

I claim:

1. Security apparatus adapted for use with a slidable-type window or the like, which comprises a two-part electrical contact switch, one of said switch parts being electrically connectible to an alarm system; means to attach said one switch part to the molding surrounding a window frame; a linearly extending bracket; and means to attach said bracket on the window frame so that the bracket is adjacent said one switch part, said second switch part being mounted on said bracket so as to be slidable with respect thereto, whereby the window frame can be slid open or slid closed, without activation of the alarm system, by holding the two switch parts in electrical contact with each other.

2. Security apparatus according to claim 1, in which the switch comprises a two-part magnetic contact switch.

3. Security apparatus according to claim 1, in which the bracket is so attached to the window frame that, when the window frame is closed, one end of the bracket is opposite said one switch part.

4. Security apparatus according to claim 3, in which the bracket is vertically attached to the window frame.

5. Security apparatus according to claim 1, in which the bracket is formed with a U-shaped linearly extending channel for slidable contact by said second switch part.

6. Security apparatus according to claim 5, in which the bracket channel faces inwardly toward the window frame, a linearly extending slot being provided in the base of said channel, and in which an element is provided within the channel for association through said slot with said second switch part for slidable retention of the second switch part on the bracket.

7. Security apparatus according to claim 6, in which the second switch part is longitudinally shaped and is slidable on the outer surface of said channel, the element within the channel is longitudinally shaped and is slidable within said channel, and means is provided for slidably retaining said second switch part and said element together.

8. Security apparatus according to claim 7, in which said retaining means comprises at least a pair of apertures in said second switch part and at least a pair of corresponding projections on said element for protrusion through said slot into respective engagement with said apertures.

9. Security apparatus adapted for use with a closure comprising a panel-like element slidable with respect to a surrounding molding, which comprises a two-part electrical contact switch, one of said switch parts being electrically connectible to an alarm system; means to mount said one switch part on said molding; a longitudinally extending bracket; and means to mount said bracket on the panel-like element so that the bracket is adjacent said one switch part, said second switch part being slidably associated with said bracket, whereby the panel-like element can be slid open or slid closed, without activation of the alarm system, by holding the two switch parts in electrical contact with each other.

* * * * *